US006362803B1

(12) United States Patent
Tomomura et al.

(10) Patent No.: US 6,362,803 B1
(45) **Date of Patent: *Mar. 26, 2002**

(54) LIQUID CRYSTAL DISPLAY HAVING ADJUSTABLE EFFECTIVE VOLTAGE VALUE FOR DISPLAY

(75) Inventors: Yoshinobu Tomomura, Nara; Tahei Nakaue, Yamatokoriyama; Nobuaki Takahashi, Nara, all of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/041,256

(22) Filed: Mar. 12, 1998

(30) Foreign Application Priority Data

Mar. 12, 1997 (JP) ..... 9-057234

(51) Int. Cl.[7] ..... G09G 3/36
(52) U.S. Cl. ..... 345/94; 345/89; 345/87
(58) Field of Search ..... 345/94, 89, 95, 345/101, 90, 97, 1, 2; 357/56

(56) References Cited

U.S. PATENT DOCUMENTS

| | | | | | |
|---|---|---|---|---|---|
| 4,149,151 | A | * | 4/1979 | Nagea et al. | 345/98 |
| 5,247,376 | A | * | 9/1993 | Wakai | 345/94 |
| 5,442,370 | A | * | 8/1995 | Yamazaki et al. | 345/94 |
| 5,506,599 | A | * | 4/1996 | Iwama | 345/94 |
| 5,508,711 | A | * | 4/1996 | Okada | 345/97 |
| 5,521,727 | A | * | 5/1996 | Inaba et al. | 345/98 |
| 5,526,012 | A | * | 6/1996 | Shibahara | 345/92 |
| 5,621,425 | A | * | 4/1997 | Hoshino et al. | 345/94 |
| 5,790,089 | A | * | 8/1998 | Ono et al. | 345/94 |
| 5,815,132 | A | * | 9/1998 | Okada et al. | 345/95 |
| 5,903,251 | A | * | 5/1999 | Mori et al. | 345/101 |
| 5,920,298 | A | * | 7/1999 | McKnight | 345/87 |

FOREIGN PATENT DOCUMENTS

| | | |
|---|---|---|
| JP | 6-118908 | 4/1994 |
| JP | 07020483 A | 1/1995 |
| JP | 07077950 A | 3/1995 |
| JP | 6-348233 | 12/1995 |
| JP | 08201779 A | 8/1996 |
| JP | 082018779 A | 8/1996 |

OTHER PUBLICATIONS

Notice of Request for Submission of Argument (corresponding application in Korea) and English translation thereof.

* cited by examiner

*Primary Examiner*—Chanh Nguyen
*Assistant Examiner*—Fritz Alphonse
(74) *Attorney, Agent, or Firm*—Dike, Bronstein, Roberts & Cushman IP Group; David G. Conlin; David A. Tucker

(57) ABSTRACT

A liquid crystal display includes a liquid crystal display panel including a signal side substrate having an arrangement of a plurality of signal electrodes, a scanning side substrate positioned opposite to the signal side substrate and having an arrangement of a plurality of scanning electrodes crossing the plurality of signal electrodes, a liquid crystal layer positioned between the signal side substrate and the scanning side substrate, and a signal side driving circuit and a scanning side driving circuit for applying driving pulse voltage signals for displaying data to the plurality of signal electrodes and the plurality of scanning electrodes, respectively for driving these electrodes. When data is displayed, at least one of the driving pulse voltage signals is provided with a correction pulse voltage signal such that the effective voltage value of each part of the liquid crystal display panel attains an optimum level. The correction is achieved by adjusting the pulse width of the correction pulse voltage signal. As a result, unevenness in display quality may be improved without crosstalk.

2 Claims, 18 Drawing Sheets

FIG. 6A VCOM1
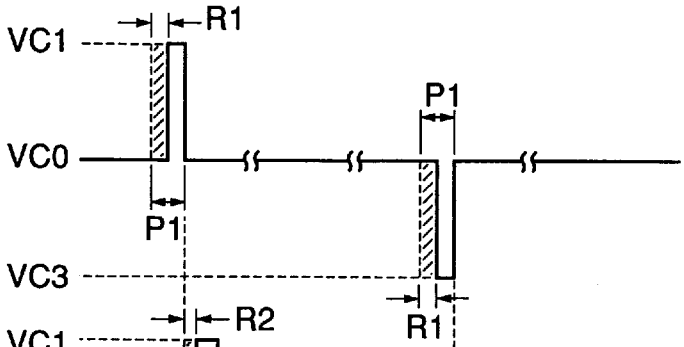
FIG. 6B VCOM2
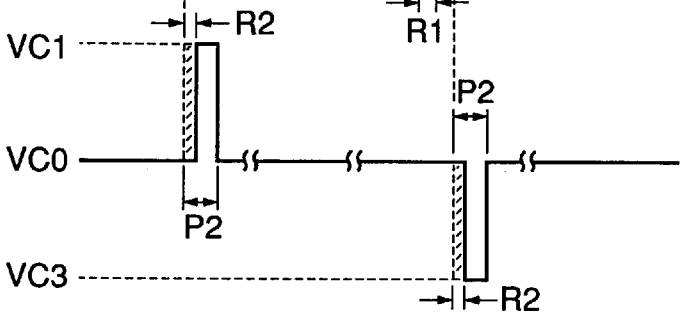
FIG. 6C VCOMm
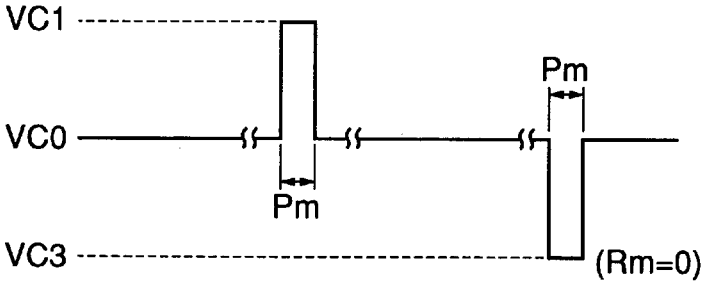
FIG. 6D VSEG1 (OFF DATA)
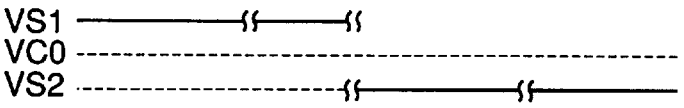

VCOM1
VC1
VC0
VC3
P1
P1

VCOM2
VC1
VC0
VC3
P2
P2

VSEG1
VS1
VC0
VS2
S1

VSEG2
VS1
VC0
VS2
S2

VSEGm
VS1
VC0
VS2
(Sm=0)

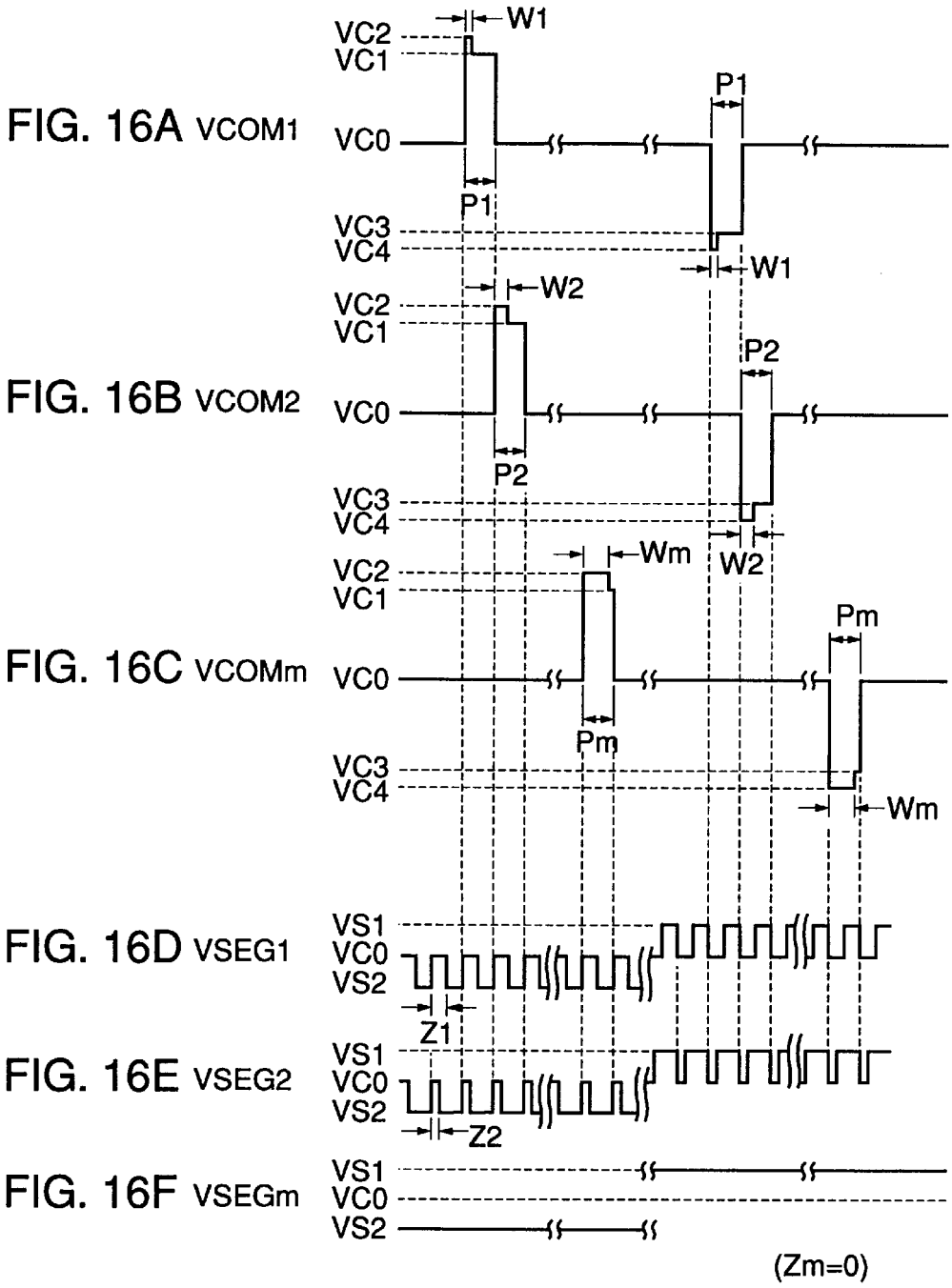
FIG. 16A VCOM1
VC2
VC1
VC0
VC3
VC4
W1
P1
FIG. 16B VCOM2
W2
P2
FIG. 16C VCOMm
Wm
Pm
FIG. 16D VSEG1
VS1
VS2
Z1
FIG. 16E VSEG2
Z2
FIG. 16F VSEGm
(Zm=0)

LIQUID CRYSTAL DISPLAY HAVING ADJUSTABLE EFFECTIVE VOLTAGE VALUE FOR DISPLAY

BACKGROUND OF THE INVENTION

1. Field of the Invention

The present invention relates generally to a simple matrix liquid crystal display for use in information equipment, AV (Audio Visual) equipment, displays for advertising purposes or the like, and more particularly, to a liquid crystal display having an adjustable effective voltage value applied to the liquid crystal panel for display.

2. Description of the Related Art

A simple matrix liquid crystal display has a liquid crystal display panel having a plurality of pixels arranged in a matrix. The liquid crystal display panel has a pair of transparent substrates opposite to each other with a layer of liquid crystal material therebetween. In one of the transparent substrates, a plurality of scanning electrodes are provided parallel to each other, and in the other transparent substrate, a plurality of signal electrodes are provided parallel to each other and orthogonal to the scanning electrodes. A pixel is sequentially selected by applying a selecting pulse from a scanning circuit to each scanning electrode, and a signal potential corresponding to the display data of the selected pixel is applied to a corresponding signal electrode for display.

In the simple matrix liquid crystal display, irregularity in the thickness of cells in the display panel, or the characteristic of orientation of the liquid crystal material could cause difference in the optimum voltage value between the central portion and the end portion of the liquid crystal display panel. Heat generated by the back light lamp causes change in the characteristics of liquid crystal material, and therefore the optimum voltage value is different between various parts of the liquid crystal panel depending upon the distance from the lamp. Such difference in the optimum voltage value on the liquid crystal display panel causes unevenness in display quality because of voiding phenomenon corresponding to the difference. This will be described in further detail. FIG. 20 is a graph showing electro-optical characteristics of a conventional liquid crystal display panel at the central and the end portion. Referring to FIG. 20, if the effective voltage value for obtaining an optimum black display is Vthm at the central part of the liquid crystal display panel and Vthl at the end portion, a voiding phenomenon is generated at the end portion in response to application of voltage at the level of effect voltage value (Vthm), because the transmissivity is larger at the end portion of the liquid crystal panel than at the central portion.

In order to solve the above-described problem, Japanese Patent Laying-Open No. 7-20483 discloses a method of improving unevenness in display quality caused by difference in the electro-optical characteristic of a liquid crystal display panel for a single matrix liquid crystal display between at its end portion and central portion because of irregularity in cell thickness and the orientation of liquid crystal material generated in the manufacture. Normally, when a liquid crystal display element is charged/discharged, the waveform of voltage actually applied to the liquid crystal material has a distortion depending upon the value of resistance of the lead wire portion of each scanning electrode and each signal electrode or the value of the internal resistance of a driving circuit, which changes the value of effective voltage applied to the liquid crystal material. In the above-described method, the value of resistance of the lead wire portion is made different between each scanning electrode and each signal electrode to change the degree of distortion of the waveform of voltage generated at each electrode, and effective voltage at an appropriate level is supplied to each part of the liquid crystal layer.

Japanese Patent Laying-Open No. 8-201779 discloses a method of improving unevenness in display quality caused by difference in the electro-optical characteristic of a liquid crystal display panel between the end portion and the central portion, because of the influence of heat generated from a lamp used for an edge light type back light. According to the method, the potential of a selecting pulse to be supplied to each scanning electrode is controlled and changed depending upon the distribution of temperature on the liquid crystal display panel which is predicted for each scanning electrode, and effective voltage at a more appropriate level is supplied to each part of the liquid crystal layer.

According to the method disclosed by Japanese Patent Laying-Open No. 7-20483, change in the effective voltage value caused by a distortion in the waveform of voltage applied to the liquid crystal layer which is generated at the time of charging/discharging the liquid crystal layer is adjusted by changing the value of resistance at each electrode. Therefore, change in the effective voltage value is disadvantageously affected by the number of inversion of the polarity of potential applied to a signal electrode. More specifically, the amount to vary the value of resistance at each electrode changes depending upon the display pattern at the liquid crystal display panel, and such method depending upon the display pattern is not preferable, if the conventional driving method is applied.

According to the method disclosed by Japanese Patent Laying-Open No. 8-201779, principally no difference appears in the effect between display patterns, because a distortion in the waveform of potential is not utilized. However, the output of a voltage supply circuit to the liquid crystal display panel should be continuously changed analog-wise from time to time, the potential supply cannot be stabilized with a simple circuit configuration, and therefore the method is subject to the influence of a distortion in the waveform of potential generated at the time of charging/discharging the liquid crystal layer, which can cause increased crosstalk.

SUMMARY OF THE INVENTION

It is an object of the invention to provide a liquid crystal display capable of applying effective voltage at an optimum level to each part of a liquid crystal display panel without using the effect of change in the value of effective voltage caused by charging/discharging the liquid crystal display panel or without changing analog-wise potential applied to each electrode in the liquid crystal display panel from time to time.

In order to achieve the above-described object, a liquid crystal display according to the present invention includes a liquid crystal display panel including a signal side substrate having an arrangement of a plurality of signal electrodes, a scanning side substrate disposed opposite to the signal side substrate and having an arrangement of a plurality of scanning electrodes crossing the plurality of signal electrodes and a liquid crystal layer between the signal side substrate and scanning-side substrate, and a signal side driving circuit and a scanning side driving circuit for applying driving pulse voltage signals to display data to the plurality of signal electrodes and the plurality of scanning electrodes, respectively for driving. In the display, at least one of the driving pulse voltage signals applied to the plurality of signal electrodes and the plurality of scanning electrodes is corrected by applying a correction pulse voltage signal such that the value of effective voltage at each part of the liquid crystal display panel attains an optimum level.

Therefore, the value of effective voltage applied to each part on the liquid crystal display panel may be corrected into an optimum level by applying the correction pulse voltage signal to the driving pulse voltage signal applied to each part. Hence, unevenness in display quality caused by the inability of supplying effective voltage at an appropriate level at each part of the liquid crystal display panel may be improved.

The pulse width of the correction pulse voltage signal can be adjusted such that the value of effective voltage applied to each part of the liquid crystal panel is at an optimum level for at least one of the plurality of scanning electrodes and the plurality of signal electrodes.

The pulse width of the correction pulse voltage signal may be adjusted for at least one of each scanning electrode and each signal electrode to set the effective voltage value of each part of the liquid crystal display panel at an optimum level. As a result, unevenness in display quality caused by the inability of obtaining optimum effective voltage at each part on the liquid crystal display panel may be improved without dependence on the display pattern or without increase in crosstalk.

The driving pulse voltage signal described above includes a data voltage signal applied to the plurality of signal electrodes for displaying data, a selecting voltage signal applied to the plurality of scanning electrodes in the selecting periods for scanning while selecting the plurality of scanning electrodes when data is displayed, and the correction pulse voltage signal includes a non-selecting voltage signal at a different level from the selecting voltage signal and applied in the non-selecting periods of the plurality of scanning electrodes. The non-selecting voltage signal is applied for a first prescribed time period to the plurality of scanning electrodes while the scanning electrodes are selected, and the first prescribed time period can be adjusted for the plurality of scanning electrodes.

The pulse width of the selecting voltage signal may be adjusted for each scanning electrode such that the effective voltage value of each part of the liquid crystal display panel attains an optimum level. Therefore, unevenness in display quality caused by the inability of obtaining an optimum effective voltage value at each part of the liquid crystal display may be improved without dependence on the display pattern or without crosstalk.

The correction pulse voltage signal includes an intermediate voltage signal applied to the plurality of signal electrodes when data is not displayed. The intermediate voltage signal is applied to the plurality of signal electrodes if data voltage signal is applied for a second prescribed time period, and the second prescribed time period can be adjusted for the plurality of signal electrodes.

Therefore, the second prescribed time period during which the intermediate voltage signal is applied to the plurality of signal electrodes may be adjusted for each signal electrode such that an optimum level effective voltage value may be obtained at each part of the liquid crystal display panel. As a result, unevenness in display quality caused by the inability of obtaining the optimum level effective voltage value at each part of the liquid crystal display panel may be improved without dependence on the display pattern or without increase in crosstalk.

The pulse width of the correction pulse voltage signal may be further adjusted following temperature changes in the liquid crystal display panel for at least one of the plurality of scanning electrodes and the plurality of signal electrodes.

As a result, the level of effective voltage applied to each part on the liquid crystal display panel may be adjusted into an optimum level based on temperature changes in the liquid crystal display panel. Consequently, unevenness in display quality caused by temperature changes in the liquid crystal display panel may be improved.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 6A to 6D are timing charts for use in illustration of the operation of the scanning side driving circuit shown in FIG. 2 according to the second embodiment;

FIGS. 16A to 16F are timing charts for use in illustration of the operation of the scanning side driving circuit and the signal side driving circuit in FIG. 15;

DESCRIPTION OF THE PREFERRED EMBODIMENTS

First to fourth embodiments of the invention will be now described.

Figure 1:
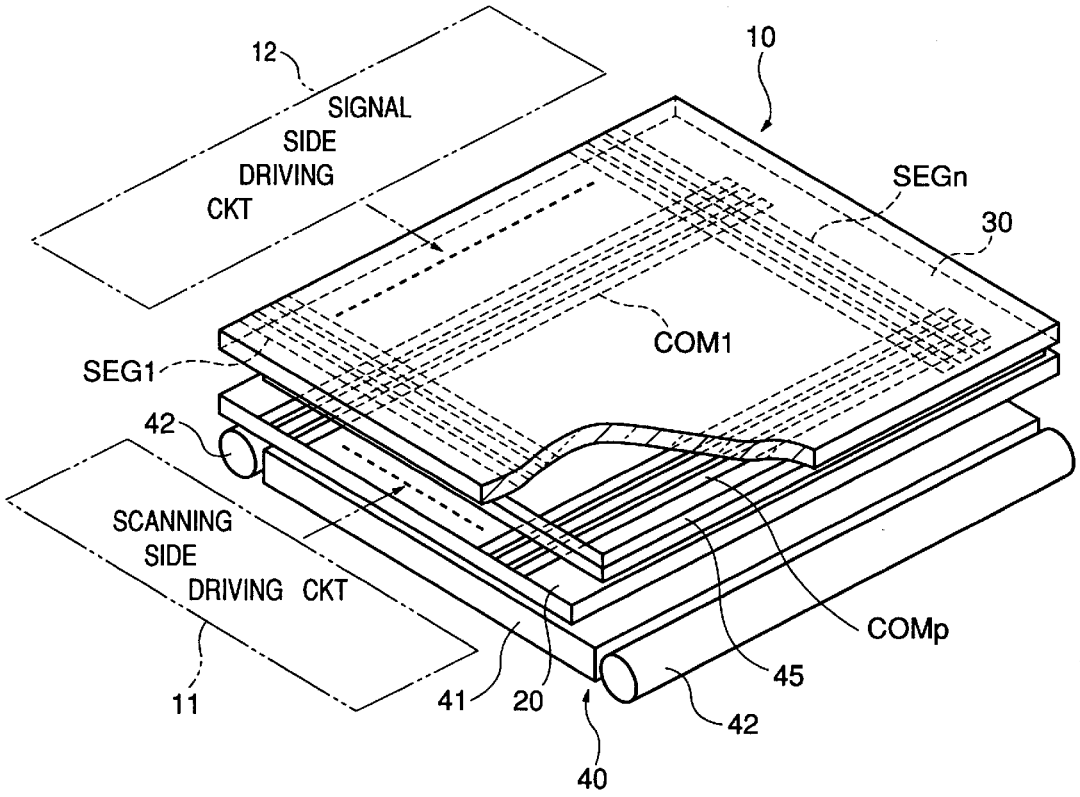
FIG. 1 is a perspective view of a liquid crystal display applied to first to fourth embodiments of the invention.

FIG. 1 is a perspective view of a liquid crystal display applied to first to fourth embodiments of the invention, the structure of the display shown in FIG. 1 is the same as that disclosed by Japanese Patent Laying-Open No. 8-201779, and therefore only a brief description will be provided here.

The liquid crystal display shown in FIG. 1 includes a single matrix liquid crystal display panel 10, a scanning side driving circuit 11 and a signal side driving circuit 12 for driving liquid crystal display panel 10, and a back light unit 40 provided on the backside of liquid crystal display panel 10.

In single matrix liquid crystal display panel 10, among a pair of transparent substrates (such as glass substrate) 20 and 30 opposite to each other with a liquid crystal layer therebetween, one substrate (the lower side substrate in FIG. 1) 20 has a plurality of scanning electrodes COMi (i=1, 2, 3, . . . , M, . . . , p) provided parallel to each other at its inner surface, and the other substrate (the upper side substrate in FIG. 1) 30 has a plurality of signal electrodes SEGi (i=1, 2, 3, . . . , m, . . . , n) provided parallel to each other and orthogonal to scanning electrodes COMi at its inner surface. Scanning electrodes COMi and signal electrodes SEGi are formed of a transparent conductive film such as ITO.

The pair of substrates 20 and 30 are joined through a frame-shaped seal member 45 and a liquid crystal material (not shown) is enclosed in the region surrounded by seal member 45 between the substrates.

Scanning side driving circuit 11 sequentially supplies a scanning signal to each scanning electrode COMi in liquid crystal display panel 10, while signal side driving circuit 12 supplies a data signal corresponding to image data to each signal electrode SEGi in liquid crystal display panel 10. Liquid crystal display panel 10 is driven by scanning side driving circuit 11 and signal side driving circuit 12 according to a so-called bipolar pulse driving method. Scanning side driving circuit 11 is connected to the terminal portion of each scanning electrode COMi, and signal side driving circuit 12 is connected to the terminal portion of each signal electrode SEGi.

Back light unit 40 is an edge light type unit. Back light unit 40 includes a light guiding plate 41 opposite to the back surface of liquid crystal display panel 10 for at least the entire display region (the region of sealed-in liquid crystal materials), and a pair of optical source lamps 42 provided opposite to both ends of light guiding plate 41.

Back light unit 40 allows light from optical source lamps 42 into liquid crystal display panel 10 through light guiding plate 41. Light from optical source lamp 42 comes into light guiding plate 41 from its both side edges, lead into the entire area through light guiding plate 41 and emitted to the front surface side after reflected at the back surface of light guiding plate 41.

First Embodiment

Figure 2:
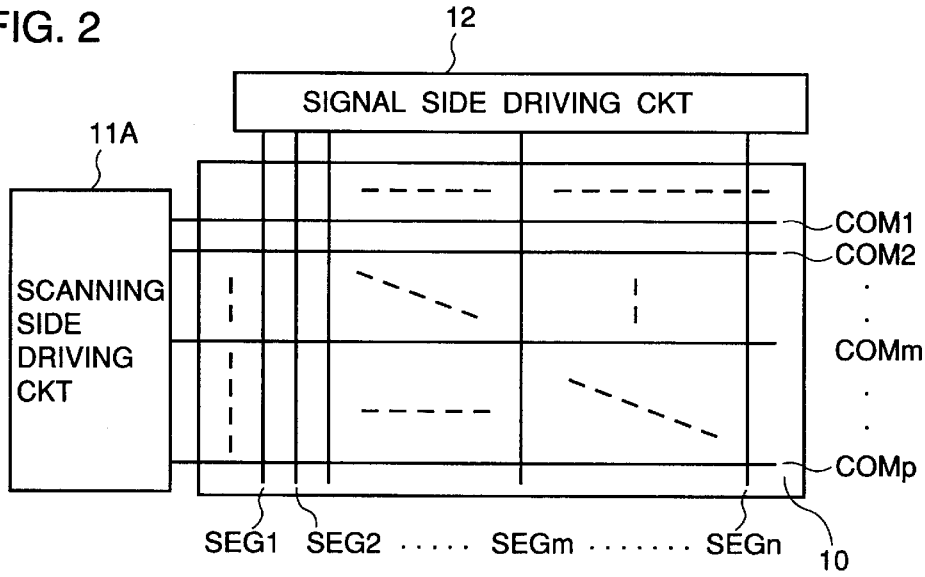
FIG. 2 is a circuit block diagram of a liquid crystal display according to the first embodiment of the invention.
Figure 3:
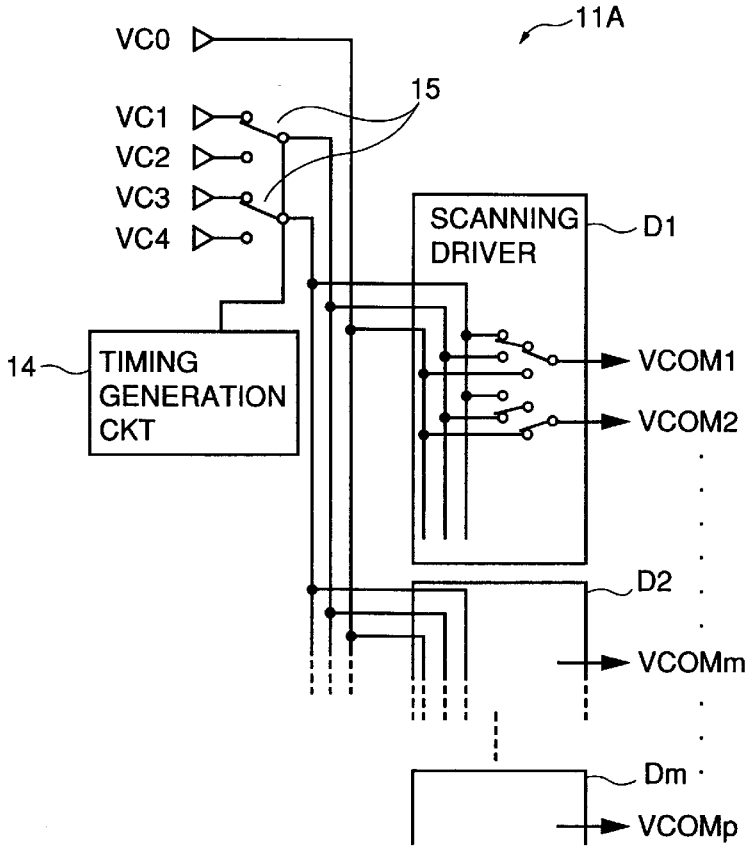
FIG. 3 is a detailed circuit diagram of the scanning side driving circuit in FIG. 2.
Figure 4A:
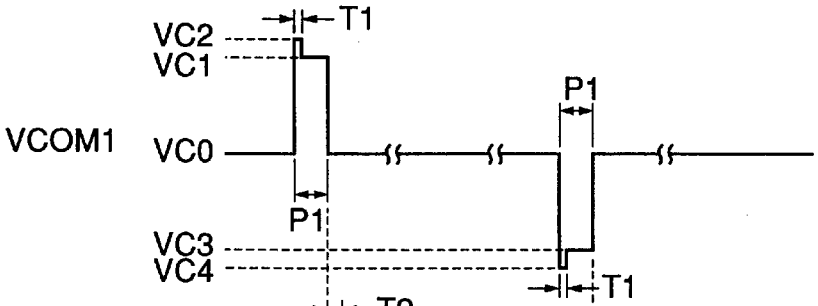
FIGS. 4A to 4D are timing charts for use in illustration of the operation of the scanning side driving circuit shown in FIG. 2 according to the first embodiment.
Figure 4B:
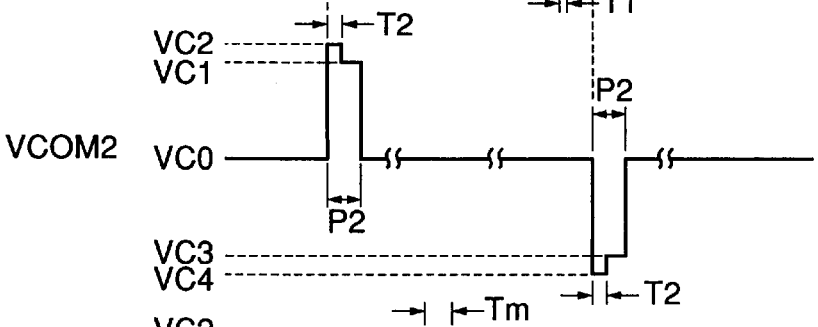
Figure 4C:
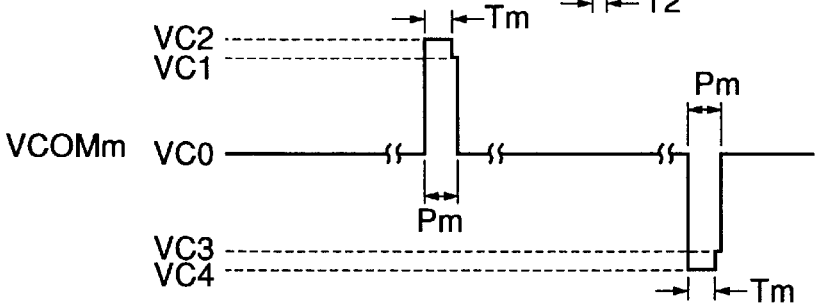
Figure 4D:
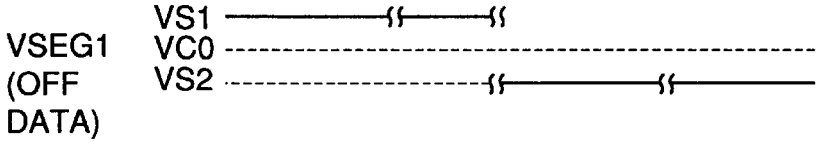

FIG. 2 is a circuit block diagram of the liquid crystal display according to the first embodiment of the invention. In FIG. 2, in association with simple matrix liquid crystal display panel 10, scanning side driving circuit 11A according to the embodiment and signal side driving circuit 12 are provided. FIG. 3 is a detailed circuit diagram of scanning side driving circuit 11A in FIG. 2. In FIG. 3, scanning side-driving circuit 11A includes a plurality of scanning drivers Dj (j=1, 2, . . . , n), and a timing generation circuit 14 and an analog switch 15 common to scanning drivers Dj.

In a normal bipolar pulse driving method, one of a non-selecting potential VCO, a selecting pulse potential VC1 having one polarity and a selecting pulse potential VC3 having the other polarity is supplied as a signal VCOMi to scanning side electrodes COMi through corresponding scanning drivers Dj. During the period in which the selecting pulse potential (VC1 or VC3) is applied (hereinafter referred to as "selecting period"), a potential applied by analog switch 15 in response to a timing generated by timing generation circuit 14 is switched to a correction pulse potential (VC2 or VC4) of the same polarity as that of the selecting pulse potential.

Note that the selecting pulse potential is a potential applied to electrodes COMi during the selecting periods for scanning while selecting scanning electrodes COMi at the time of displaying data. The non-selecting potential is a potential applied during the non-selecting periods to scanning side electrodes COMi. A signal potential for displaying data is applied to signal electrodes SEGi, and an intermediate potential at a different level from the signal potential is applied when data is not displayed.

FIGS. 4A to 4D are timing charts for use in illustration of the operation of scanning side driving circuit 11A in FIG. 2 according to the first embodiment. FIGS. 4A to 4D show the potential waveforms of signals VCOM1, VCOM2, VCOMm and VSEG1 applied to scanning electrodes COM1, COM2 and COMm, and signal electrode SEG1. In FIGS. 4A to 4D, for scanning electrodes COM1, COM2 and COMm, selecting periods P1, P2 and Pm, and time periods T1, T2 and Tm during which a correction pulse potential is applied (hereinafter referred to as "correction period") in selecting periods P1, P2 and Pm are indicated.

Note that the intermediate potential at signal electrodes SEGi and non-selecting potential VCO at scanning electrodes COMi are at the same level and commonly used.

Selecting period Pi has the same length for scanning electrodes COMi, but correction period Ti is different between the electrodes.

The display state of a pixel formed at the crossing of each scanning electrode and each signal electrode is determined by the effective value of difference between potentials applied to the scanning electrode and to the signal electrode (hereinafter referred to as "effective voltage value"). Therefore, the time periods for applying a correction pulse potential (T1, T2 and Tm) may be adjusted for each scanning electrode in order to adjust the effective voltage value to each pixel on a scanning electrode-basis, if the same potential is applied to each signal electrode. More specifically, in liquid crystal display panel 10 having the electro-optical characteristic shown in FIG. 20, correction period Tm for signal VCOMm to select scanning electrode COMm in the m-th row is set such that the effective voltage value is at the level of Vthm if the display data is black. Correction period T1 for signal VCOM1 to select scanning electrode COM1 in the first row is also set such that the effective voltage value is at the level of Vth1 if the display data is black. The correction periods for the signals to select the other scanning electrodes are similarly set. Thus, correction period Ti is appropriately set for scanning electrodes COMi, and therefore equal black levels are obtained regardless of display locations in liquid crystal display panel 10.

A method of setting such correction period Ti will be now described.

Figure 5:
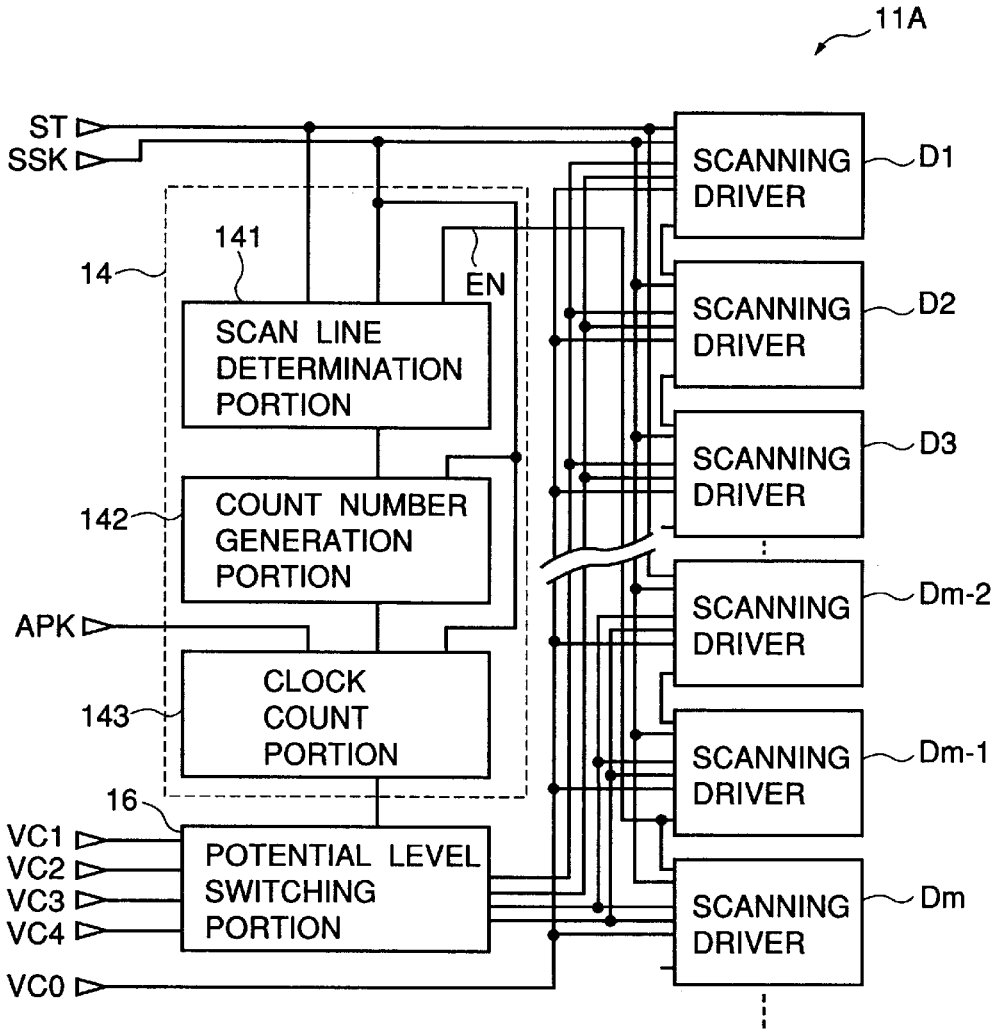
FIG. 5 is a further detailed circuit diagram of the scanning side driving circuit in FIG. 3.

FIG. 5 is a further detailed circuit diagram of scanning side driving circuit 11A in FIG. 3. In FIG. 5, scanning side driving circuit 11A includes a plurality of series-connected scanning drivers Dj, a timing generation circuit 14 including a scanning line determination portion 141, a count number generation portion 142 and a clock count portion 143, and a potential level switching portion 16 including an analog switch 15 as shown in FIG. 3.

Timing generation circuit 14 determines the position of a selected scanning electrode COMi depending upon the count number of enable signals EN between drivers Dj and the count number of scanning side shift clock SSK. Clock count portion 143 determines correction period T1 corresponding to the pulse width of a correction pulse potential to each scanning electrode COMi by counting a correction pulse setting clock APK. The count number by clock count portion 143 may be changed for each scanning electrode COMi to supply appropriate level effective voltage to each scanning electrode COMi.

Patterning by a logic circuit or a ROM may be used to obtain an optimum count number for each scanning electrode COMi. By changing the frequency of correction pulse setting clock APK, the amount of correction may be adjusted while maintaining the ratio of correction period Ti to selection period for each scanning electrode COMi.

Meanwhile, an effective voltage value Vthxon to each scanning electrode COMi at the time of ON display and an effective voltage value Vthxoff at the time of OFF display are given by the following expressions, respectively using the correction pulse potential and correction period.

$$Vthxon = \sqrt{\left\{VAon^2 \frac{tx}{\tau} + VBon^2 \frac{(\tau - tx)}{\tau} + VCon^2(D-1)\right\} \Big/ D}$$

$$Vthxoff = \sqrt{\left\{VAoff^2 \frac{tx}{\tau} + VBoff^2 \frac{(\tau - tx)}{\tau} + VCoff^2(D-1)\right\} \Big/ D}$$

wherein Vthxon is optimum effective voltage at the time of ON display of COMx (x-th scanning electrode), Vthxoff is optimum effective voltage at the time of OFF display of COMx (x-th scanning electrode), tx is a correction pulse application period to COMx, τ is-a selecting pulse application period, D is a duty ratio, and VAon=VC2−VS2, VBon=VC1−VS2, VCon=VC0−VS2, VAoff−VC2−VS1, VBoff=VC1−VS1, and VCoff=VC0−VS1.

The values VBon, VBoff, VCon and VCoff are determined based on the characteristic of the central portion of liquid crystal display panel 10 and the circuit configuration, and therefore values tx, VAon, and VAoff are determined, in view of previously measured optimum effective voltage values Vthxon and Vthxoff at the time of ON display and OFF display, respectively at each part of liquid crystal display panel 10. Meanwhile, these values may be mannually set while actually viewing the display to eliminate unevenness in display quality.

Note that a potential conventionally used for correcting crosstalk may be utilized for the correction pulse potential. In that case, it is not necessary to add a new power supply circuit system.

In association with correction of the value of effective voltage for reducing the effect of heat emitted from lamps 42, the amount of correction should be changed corresponding to change in heat with time. For this purpose, temperature changes in the surface of liquid crystal display panel 10 are detected using a temperature sensing element such as thermistor and the frequency of correction pulse setting clock APK or the correction pulse potential (VC2 or VC4) may be changed following the temperature changes.

In the liquid crystal display according to this embodiment, optimum level effective voltage may be applied depending upon display at each part of liquid crystal display panel 10, unevenness in display quality may be improved on a scanning electrode COMi-basis. In addition, since the correction pulse potential is used for correcting the effective voltage value, in other words the correction amount is not changed analog-wise, crosstalk may be prevented from increasing. Note that according to this embodiment, analog switch 15 is used for switching between the selecting pulse potential (VC1 or VC3) and the correction pulse potential (VC2 or VC4), but a semiconductor switch circuit such as FET may be used.

Second Embodiment

In the second embodiment, in place of the application of the correction pulse potential in the first embodiment, a non-selecting potential VCO is applied during the selecting period Pi of each scanning electrode COMi to correct the effective voltage value.

FIGS. 6A to 6D are timing charts showing the operation of a scanning side driving circuit 11A as shown in FIG. 2 according to the second embodiment. FIGS. 6A to 6D show the potential waveforms of signals VCOM1, VCOM2, VCOMm and VSEG1 applied to scanning electrodes COM1, COM2, COMm and signal electrode SEG1, respectively as shown in FIG. 2. In the figures, selecting periods P1, P2 and Pm for scanning electrodes COM1, COM2 and COMm are shown, while periods R1, R2 and Rm for applying non-selecting potential VCO in periods P1, P2 and Pm, respectively are shown. Period Ri has a different length for each scanning electrode COMi.

Also in this embodiment, using timing generation circuit 14 according to the first embodiment, the position of scanning electrode COMi to be selected is determined and periods R1, R2, . . . , and Rp for applying non-selecting potential VCO may be set.

Note that in the first embodiment, potentials VC2 and VC4 in FIG. 5 are used as a correction potential, potential VCO is used as a correction potential in the second embodiment. The timing for switching at potential level switching portion 16 is different between the first and second embodiments. The other features are common to the first and second embodiments.

Thus, in the liquid crystal display according to this embodiment, non-selecting potential VCO is applied during a prescribed time period Ri for each scanning electrode COMi in selecting period Pi for each scanning electrode COMi to apply optimum level effective voltage to each part of liquid crystal display panel 10, and therefore unevenness in display quality may be improved on a scanning electrode COMi-basis. Furthermore, since the amount to correct is determined based on whether or not to apply non-selecting potential VCO, in other words the amount of correction is not changed analog-wise, increase in crosstalk may be prevented.

Third Embodiment

Figure 7:
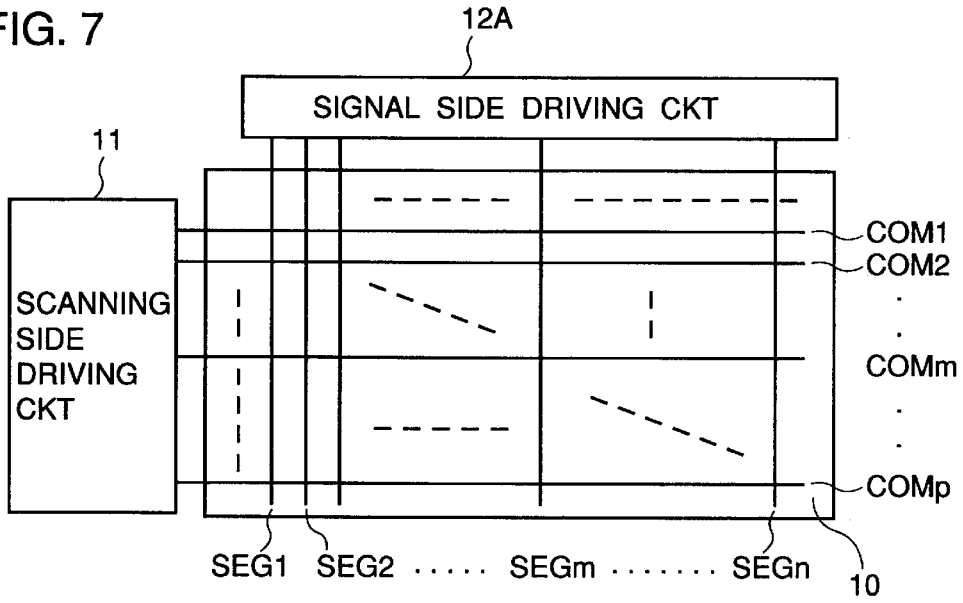
FIG. 7 is a circuit block diagram of a liquid crystal display according to the third embodiment of the invention.

FIG. 7 is a circuit diagram of a liquid crystal display according to a third embodiment of the invention.

The circuit in FIG. 7 is substantially the same as that in FIG. 2 with essential difference being that signal side driving circuit 12 is replaced by a signal side driving circuit 12A and scanning side driving circuit 11A is replaced by a conventional circuit 11, and therefore signal side driving circuit 12A will be described here.

Figure 8:
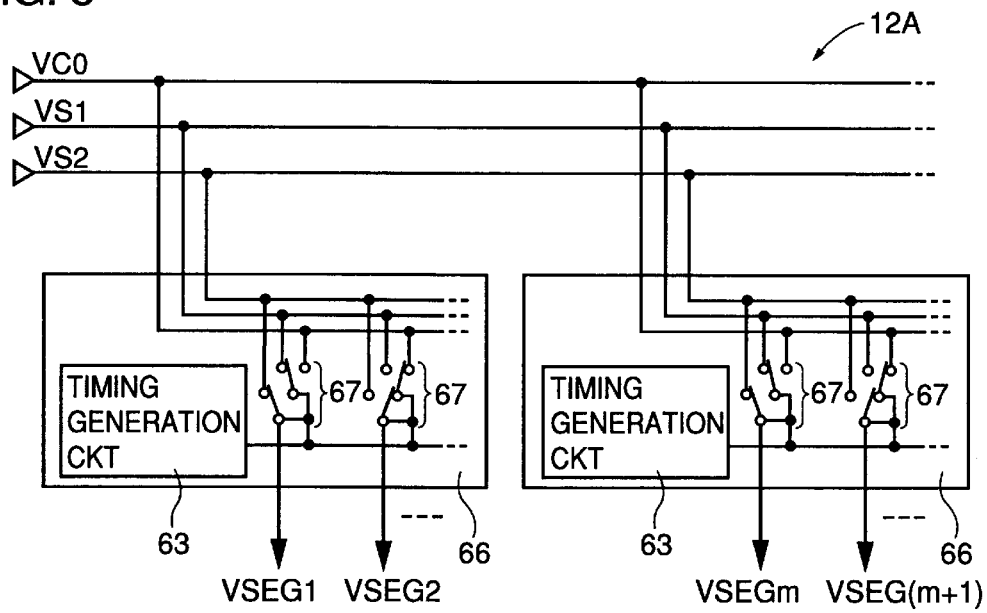
FIG. 8 is a circuit block diagram of the signal side driving circuit according to the third embodiment of the invention.
Figures 9A, 9B, 9C, 9D, 9E:
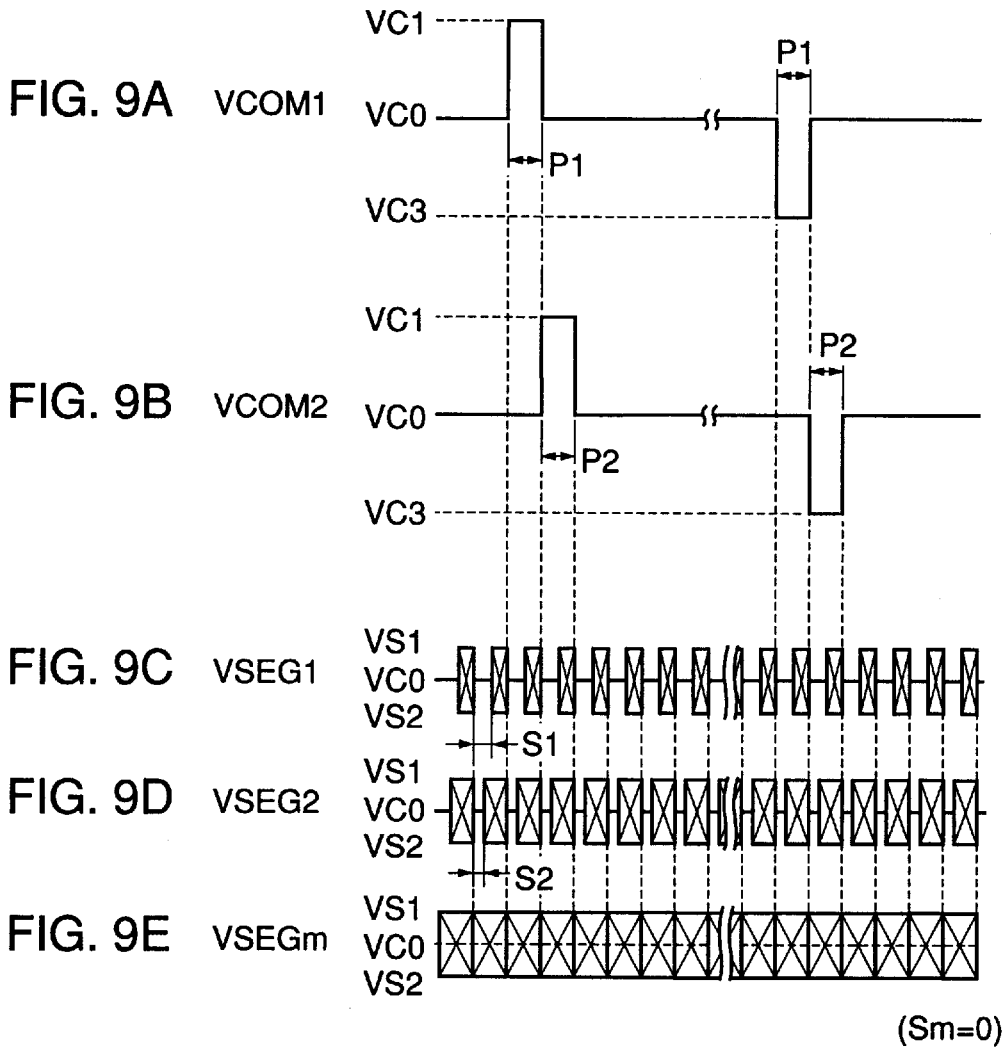
FIGS. 9A to 9E are timing charts for use in illustration of the operation of the signal side driving circuit in FIG. 8.

FIG. 8 is a circuit diagram of the signal side driving circuit according to the third embodiment. signal side driving circuit 12A shown in FIG. 8 includes a series-connection of a plurality of signal electrode side drivers 66 each including a timing generation circuit 63 and a plurality of analog switches 67 switched under the control of timing generation circuit 63. Although timing generation circuit 63 is provided for each of signal electrode side drivers 66 in FIG. 8, one such timing generation circuit 63 may be provided for all the analog switches 67.

In a normal bipolar pulse driving method, signal electrodes SEGi are each provided with one of signal potentials VS1 and VS2 through analog switch 67 depending upon display data. At the time, in response to a timing output by timing generation circuit 63, the potential applied through analog switch 67 is switched between one of signal potentials VS1 and VS2 and intermediate potential VCO therebetween.

FIGS. 9A to 9E are timing charts for use in illustration of the operation of signal side driving circuit 12A in FIG. 8. In FIGS. 9A to 9E, the potential waveforms of signals VSEG1, VSEG2, VSEGm, VCOM1 and VCOM2 applied to signal electrodes SEG1, SEG2 and SEGm and scanning electrodes COM1 and COM2, respectively. In FIGS. 9A to 9E, the selecting periods P1 and P2 of scanning electrodes COM1 and COM2 are shown, and periods S1, S2 and Sm for applying the intermediate potential to signal electrodes SEG1, SEG2 and SEGM are shown.

The display state of pixels formed at the crossings of scanning electrodes COMi and signal electrodes SEGi are determined based on the effective value of the difference between the applied potential VCOMi applied to a scanning electrode and potential VSEGi applied to a corresponding signal electrode, and therefore the effective voltage value to each pixel may be adjusted on a signal electrode SEGi-basis by adjusting intermediate potential application period Si for each signal electrode SEGi even if the potential of scanning electrode COMi is the same.

Note that the intermediate potential of signal electrode SEGi and the non-selecting potential of scanning electrode COMi have the same potential level and commonly used. "X" in signals VSEG1, VSEG2 and VSEGm indicate that these signals attain one of signal potentials VS1 and VS2.

Figure 20:
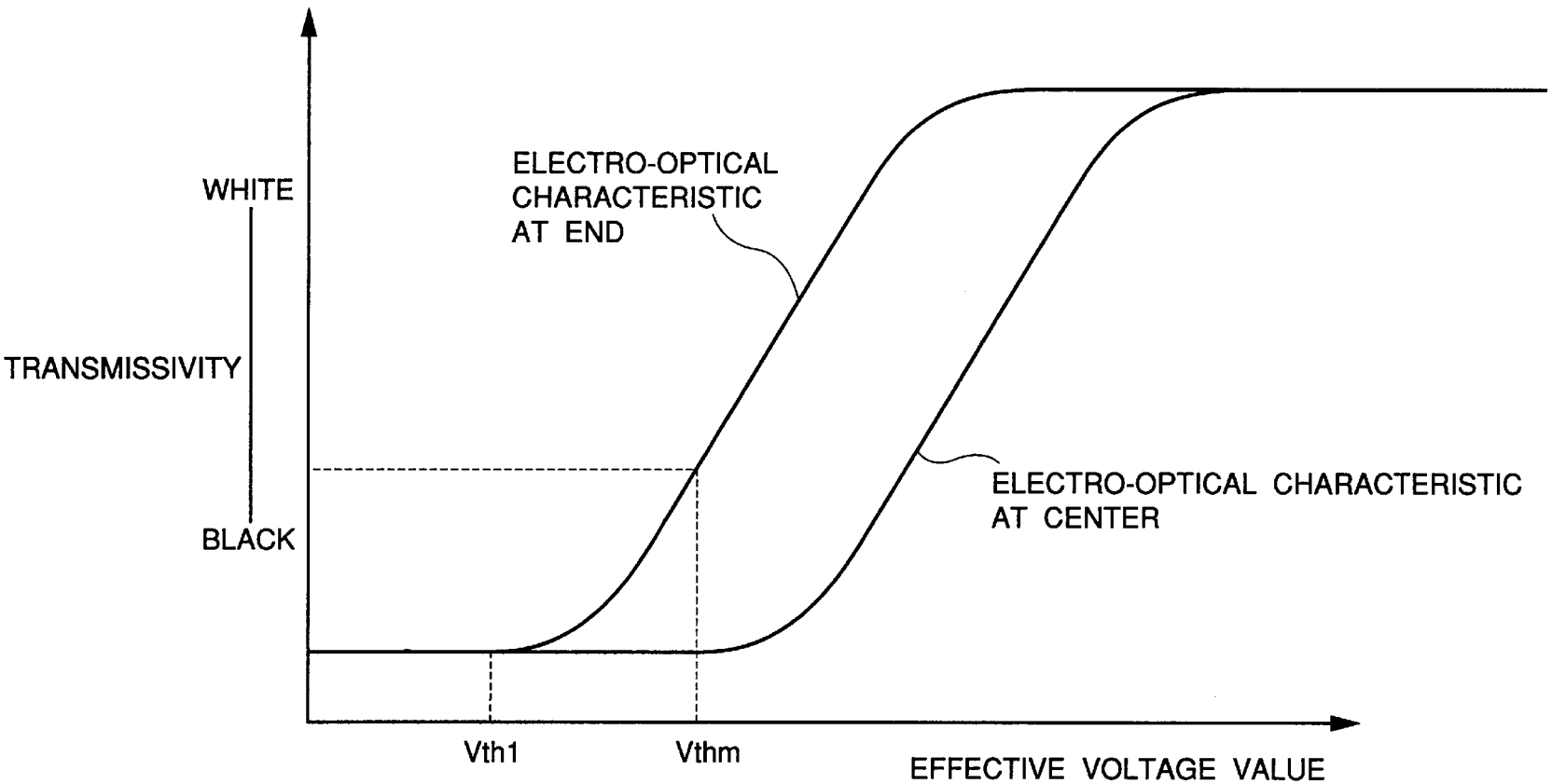
FIG. 20 is a graph showing the electro-optical characteristic of a conventional liquid crystal display panel at its central portion and end portion.

More specifically, in liquid crystal display panel 10 having the electro-optical characteristic as shown in FIG. 20, the effective value of signal VSEGm applied to signal electrode SEGm in the m-th column attains a level of Vthm in intermediate potential application period Sm if display data is black. The effective value of signal VSEG1 applied to signal electrode SEG1 in the first column attains a level of Vthl during intermediate potential application period S1 if display data is black. The other signal electrodes SEGi are set in a similar manner. Thus, an identical black level is available for each part of liquid crystal display panel 10.

Figure 10:
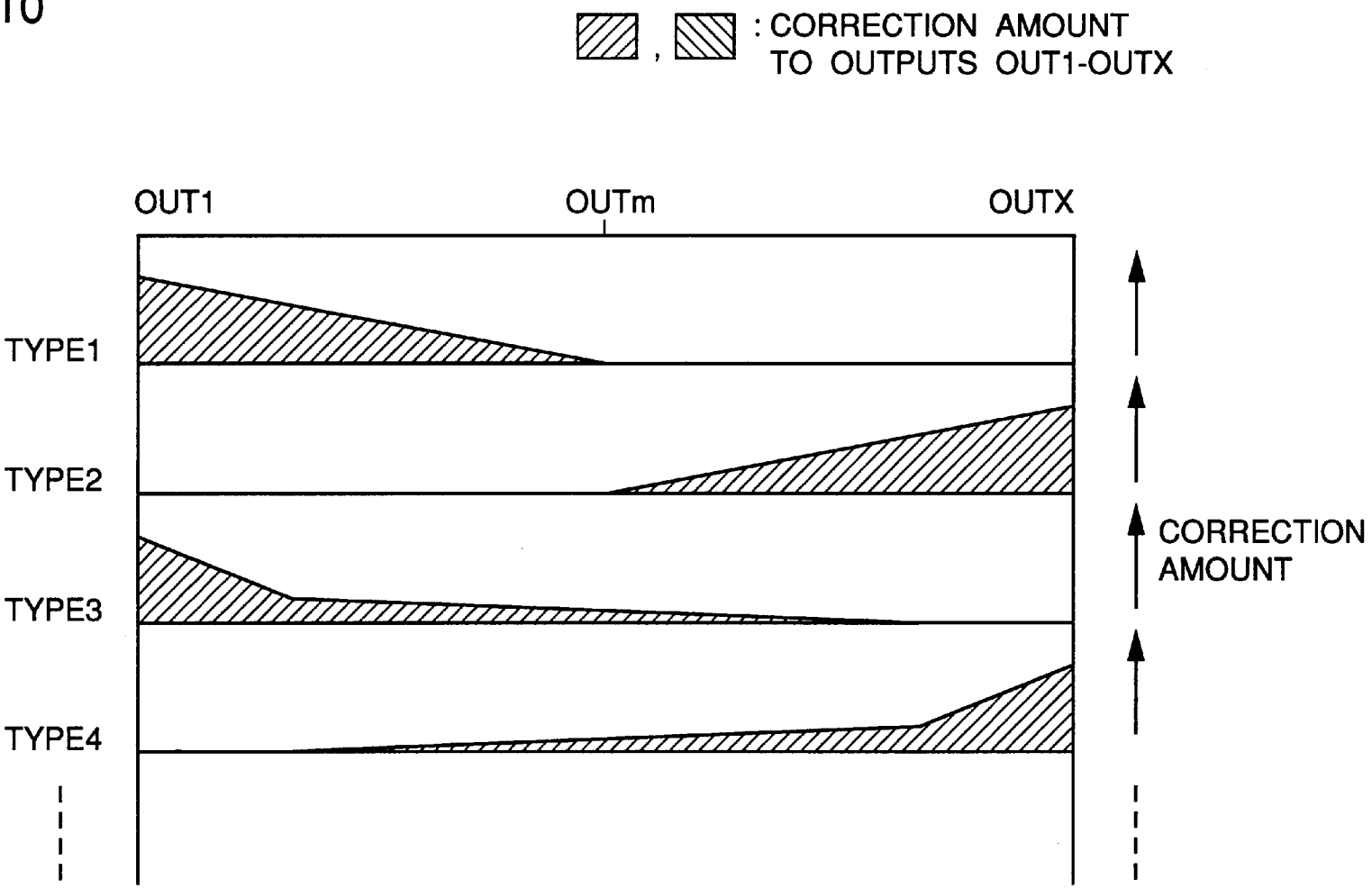
FIG. 10 is a chart showing types of output correction characteristic of the signal electrode side driver according to the third embodiment of the invention.

FIG. 10 shows particular types of output correction characteristic of signal electrode side driver 66 according to the third embodiment of the invention. Signal side driving circuit 12A normally includes a column of drivers in which a plurality of signal electrode side drivers 66 are connected in series as shown in FIG. 8. In liquid crystal display panel 10, the region having an electro-optical characteristic significantly deviated from the V-T (Voltage-Transmissivity) characteristic of the central portion of liquid crystal display panel 10 as shown in FIG. 20 only corresponds to the range of drivers 66 on both ends of the driver column, and therefore the effective voltage values in this range needs only be corrected. As shown in FIG. 10, the amount of correction of the output of each driver 66 could be in several kinds, considering the region to correct its effective voltage value on display panel 10 and the characteristic of correction. As a result, a plurality of patterns of correction characteristic (TYPE1, TYPE2, . . . ) are stored in signal electrode side driver 66, and a pattern of correction characteristic may be set depending upon which part of liquid crystal display panel 10 the position of a corresponding driver 66 corresponds to. For example, a correction characteristic pattern may be selected from outside driver 66.

Herein, the amounts of correction related to the effective voltage values of outputs OUT1 to OUTx of signal electrode side drivers 66 are denoted by the shadowed portions in FIG. 10. More specifically, in correction pattern TYPE1, the amount of correction at output OUT1 is largest for signal electrode side driver 66 at one end of the driver column, the amount of correction stably decreases toward the intermediate level output OUTm, and there is no correction at output OUTm. Correction pattern TYPE2 has a symmetric characteristic to correction pattern TYPE1, and the amount of correction for driver 66 provided at a symmetric position to driver 66 to be corrected in the driver column, in other words the amount of correction for driver 66 provided at the other end of the driver column is indicated. In correction pattern TYPE3, the amount of correction at output OUT1 of driver 66 at one end of the driver column is largest, the amount of correction stably decreases toward the intermediate level output OUTm, and thereafter, the amount of decrease is reduced as shown. Note that correction pattern TYPES2 and 4 indicate the correction characteristics of driver 66 provided at the end on the opposite side to driver 66 to have correction pattern TYPES 1 and 3 in the driver column.

Now, a method of setting intermediate potential application period Si will be described.

Figure 11:
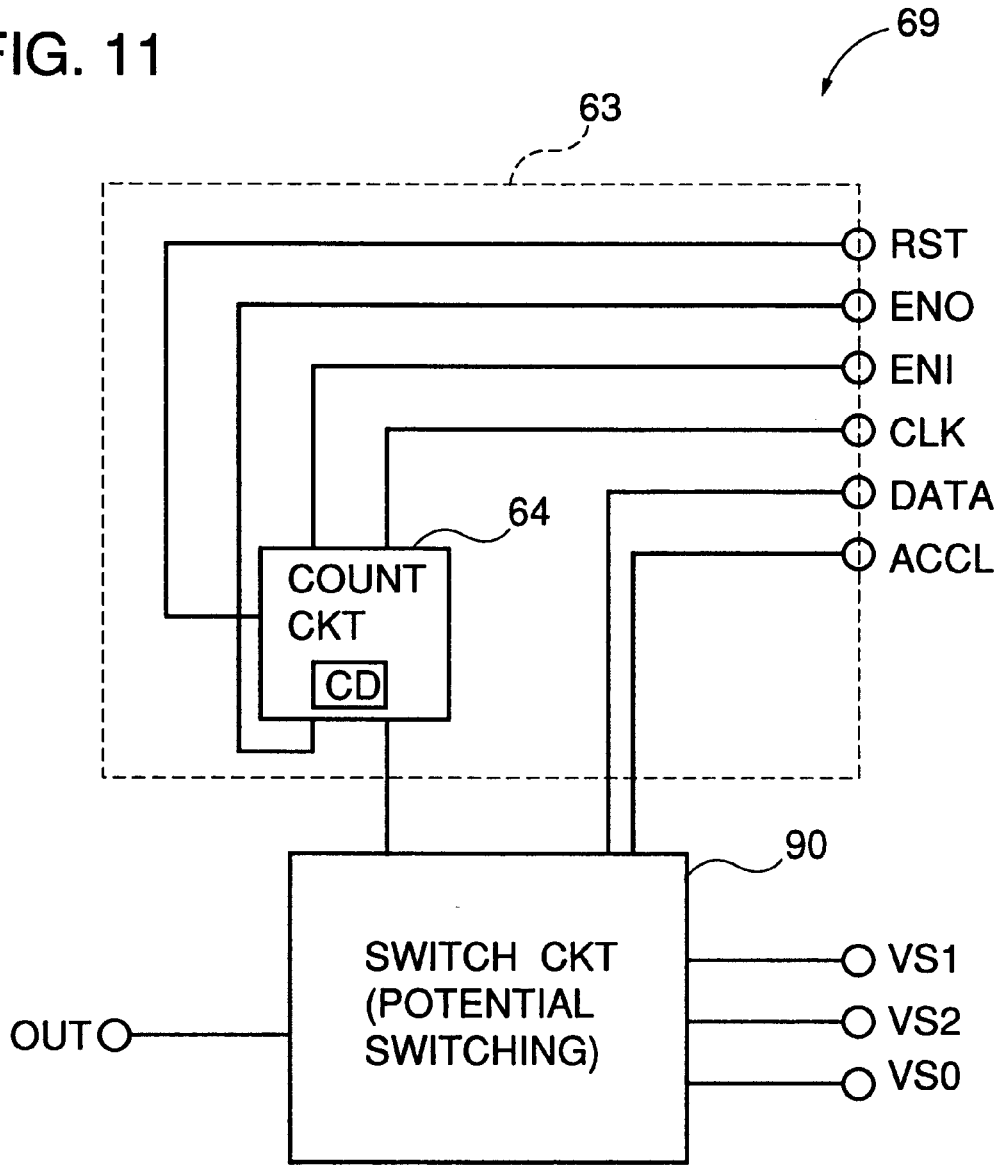
FIG. 11 is a block diagram of an output circuit provided in the signal electrode side driver in FIG. 8 for controlling an output to the signal electrode.
Figure 12:
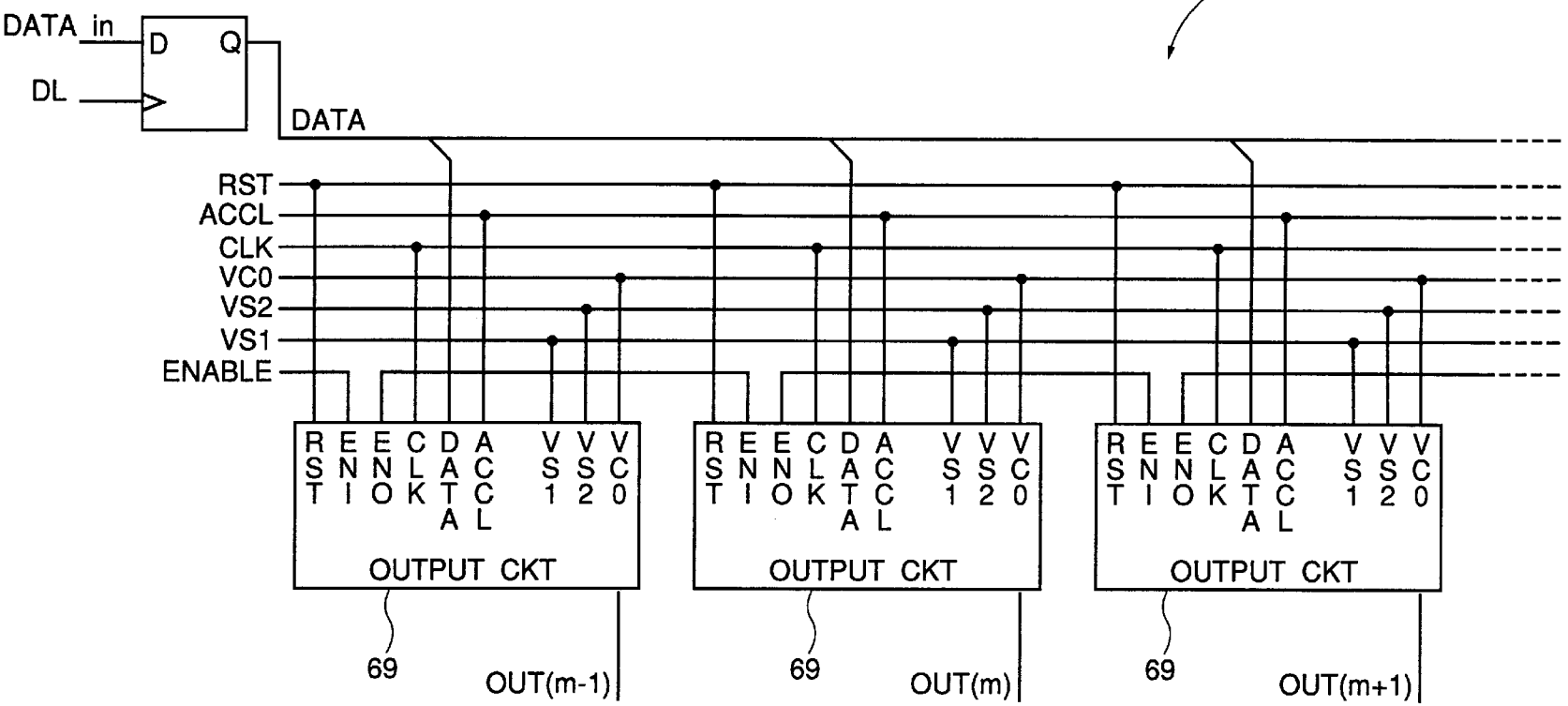
FIG. 12 is a diagram showing the connection between the output circuits in FIG. 11 in the signal electrode side driver shown in FIG. 8.

FIG. 11 is a block diagram of output circuit 69 provided in signal electrode side driver 66 for controlling the output of driver 66 to signal electrode SEGi. FIG. 12 is a diagram showing the connection between output circuits 69 in FIG. 11 in signal electrode side driver 66 in FIG. 8. In FIG. 11, output circuit 69 includes a timing generation circuit 63 including a count circuit 64 and a switch circuit 90 including an analog switch 67 for switching the potential. In the configuration shown in FIGS. 10 and 11, intermediate potential VCO is output to the output terminal OUT of each output circuit 69 by input of a counter reset signal RST in synchronization with the data latch signal DL of signal side driving circuit 12A.

For output terminal OUT which does not require correction, in other words output circuit 69 for driver 66 whose amount of correction as shown in FIG. 10 is 0, counter reset signal RST is not input such that intermediate potential VCO is not output to this output terminal OUT and no correction is made. Count data CD based on the above-described correction characteristics (number of clocks determining a correction period) is stored in the count circuit 64 of each output circuit 69. Count data CD may be implemented by patterning using an internal logic circuit.

The operation of output circuit 69 at output terminal OUT(m) shown in FIG. 12 will be now described by way of illustration. Output circuit 69 at output terminal OUT(m) receives a count enable in signal ENI from output circuit 69 at adjacent output terminal OUT(m−1) and counts by the amount of count data CD with a clock CLK for correction. Once the counting completes, signal potential VS1 (or VS2) is output to output terminal OUT(m) by a signal from count circuit 64. At the time, a count enable out signal ENO is applied to output circuit 69 at output terminal OUT(m+1) as count enable in signal ENI, and output circuit 69 at output terminal OUT(m+1) performs the same operation as the above.

Thereafter, the series of operations are sequentially repeated by output circuits 69, and intermediate potential application period Si may be made different for each output terminal OUT, and signal voltage having its effective voltage appropriately corrected for each signal electrode SEGi may be supplied.

Figure 13:
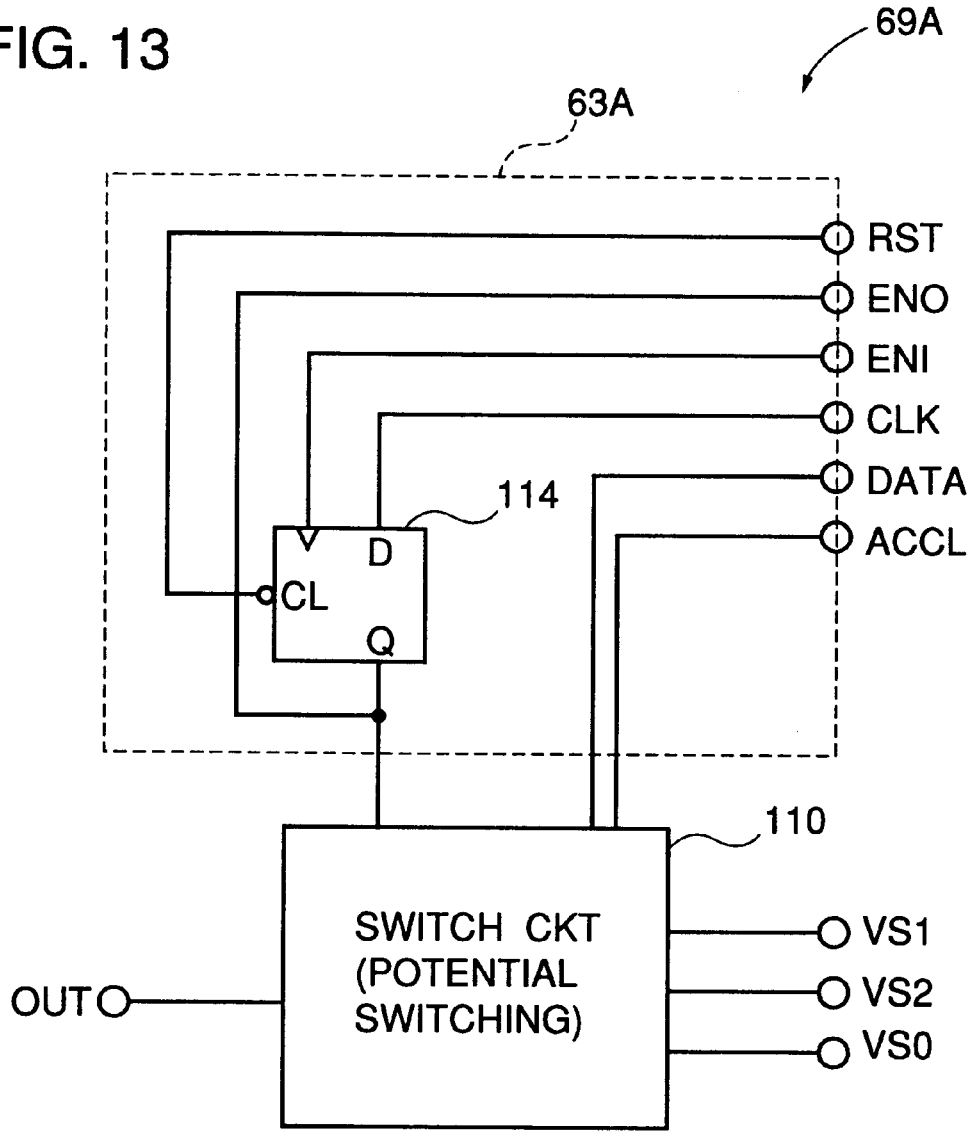
FIG. 13 is a diagram of an output circuit simplified based on the output circuit in FIG. 11.

FIG. 13 is a diagram of a simplified output circuit based on output circuit 69 in FIG. 11.

Figure 14:
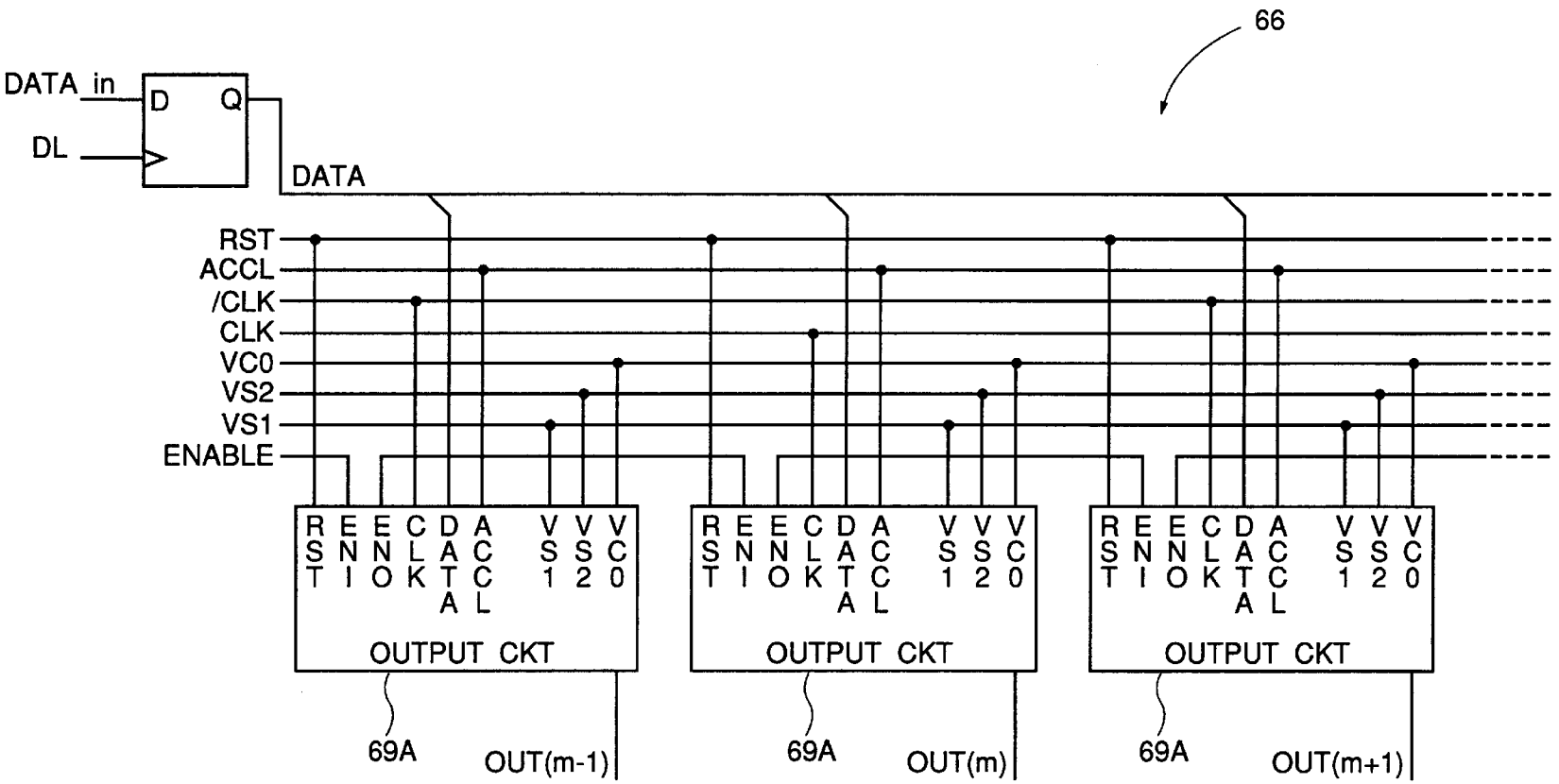
FIG. 14 is a diagram showing the connection between output circuits as shown in FIG. 13 in the signal electrode side driver in FIG. 8.

FIG. 14 is a diagram showing the connection of output circuits 69A in FIG. 13 in signal electrode side driver 66 as shown in FIG. 8.

The above-described operations are performed in a simpler method as follows. If the values of count data CD in count circuit 64 at each output circuit 69 are all set to "1", only the linear characteristic of correction pattern TYPE1 or 2 is obtained in FIG. 10. Meanwhile, count circuit 64 may be formed only by a D type flipflop 114 as in output circuit 69A shown in FIG. 13, in other words the configuration of the output circuit may be simplified. By connecting output circuits 69A in driver 66 as shown in FIG. 14 and using clocks of two phases, clock CLK for correction and clock/CLK in the opposite phase, the difference between application periods Si for the intermediate potentials at output terminals OUT at output circuits 69A corresponds to the period ½ the cycle of clock CLK for correction. Therefore, in the arrangements shown in FIGS. 13 and 14, the frequency of clock CLK for correction may be lower than the arrangement shown in FIGS. 11 and 12, and power consumption by the liquid crystal display may be reduced.

The liquid crystal display according to this embodiment may apply appropriate level effective voltage to each part of liquid crystal display panel 10, and therefore unevenness in display quality may be improved on a signal electrode SEGi-basis. Furthermore, since the amount of correction to correct the effective voltage value to the optimum level is not changed analog-wise, crosstalk may be prevented from increasing.

In the arrangement shown in FIGS. 12 and 14, the amount of correction may be adjusted while maintaining the ratio of intermediate potential application period Si by changing the frequency of clock CLK for correction.

Fourth Embodiment

Figure 15:
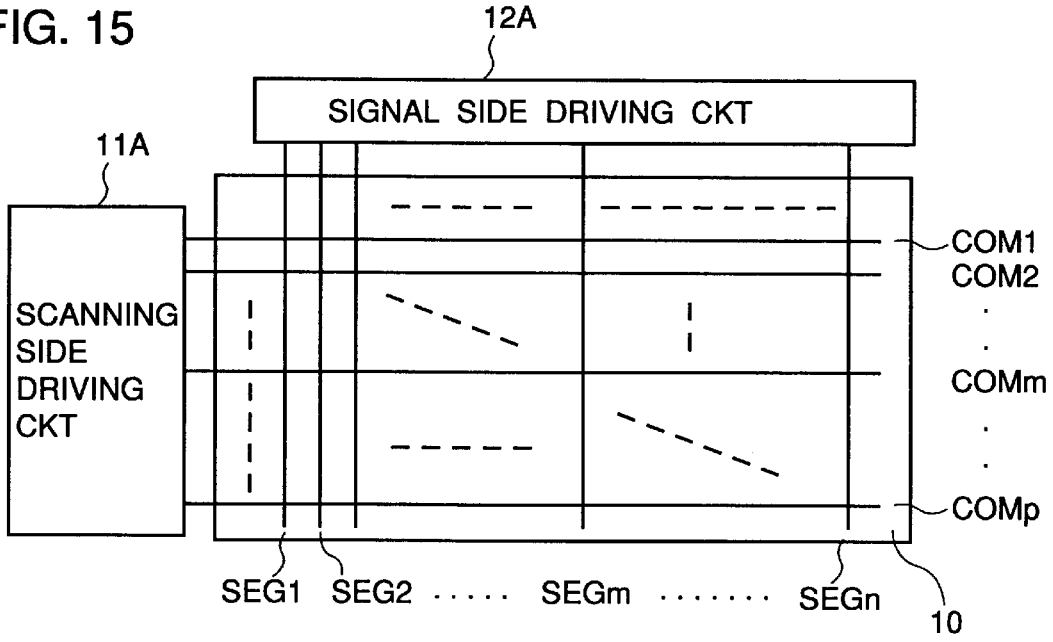
FIG. 15 is a circuit block diagram of a liquid crystal display according to the fourth embodiment of the invention.

A liquid crystal display according to a fourth embodiment includes both the arrangements of the first and third embodiments. FIG. 15 is a circuit block diagram of the liquid crystal display according to the fourth embodiment of the invention. In FIG. 15, scanning side driving circuit 11A according to the first embodiment and signal side driving circuit 12A according to the third embodiment are provided for liquid crystal display panel 10. In this embodiment, the non-selecting potential of scanning side driving circuit 11A and the intermediate potential of signal side driving circuit 12A are at the same level and commonly used.

Figure 17A:
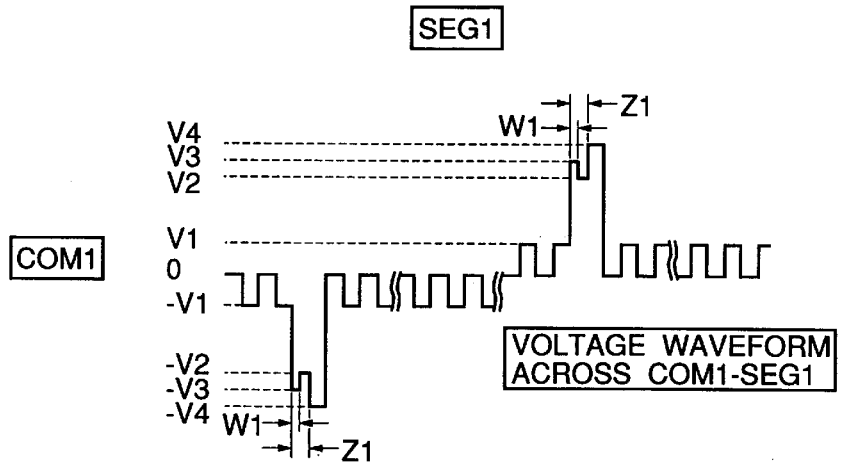
FIGS. 17A to 17C are charts showing the potential waveforms of pixels formed at the crossings of scanning electrodes COM1, COM2 and COMm and signal electrode SEG1, respectively according to the fourth embodiment of the invention.
Figure 17B:
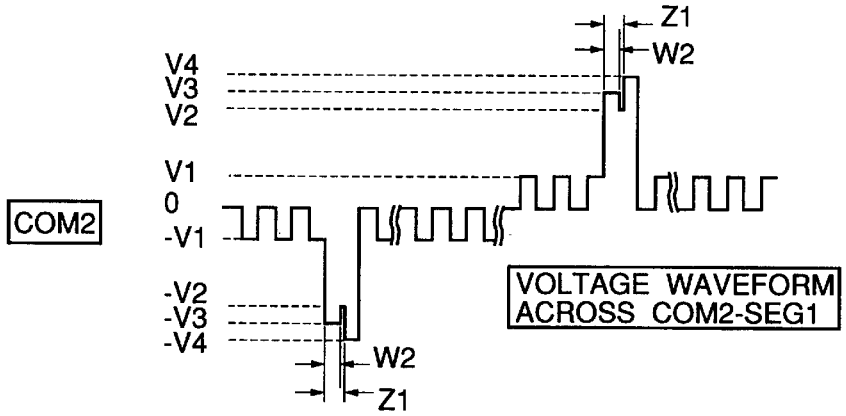
Figure 17C:
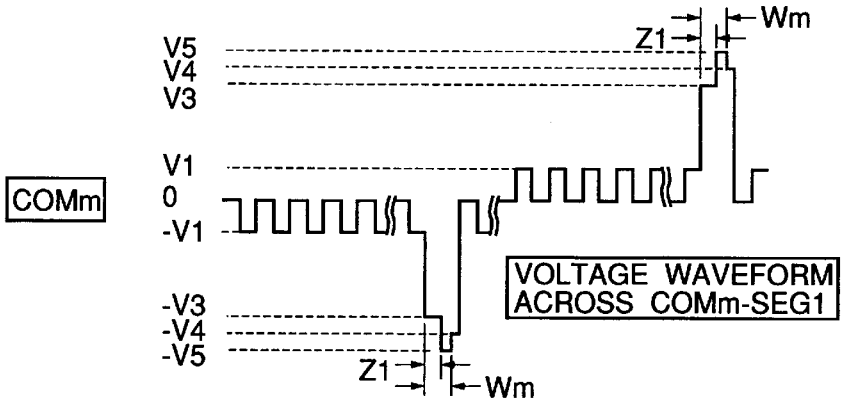
Figure 18A:
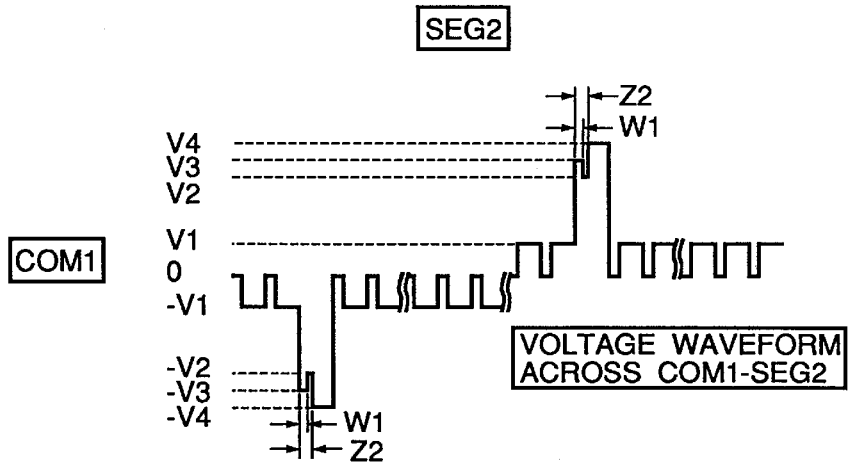
FIGS. 18A to 18C are charts showing the potential waveforms of pixels formed at the crossings of scanning electrodes COM1, COM2 and COMm and signal electrode SEG2, respectively according to the fourth embodiment of the invention.
Figure 18B:
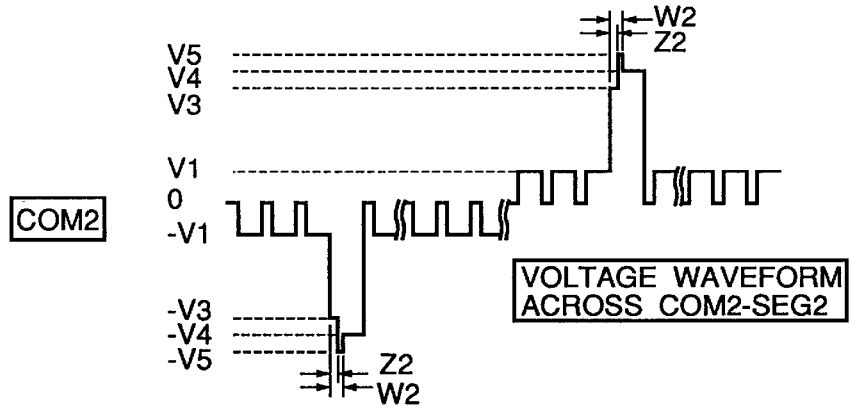
Figure 18C:
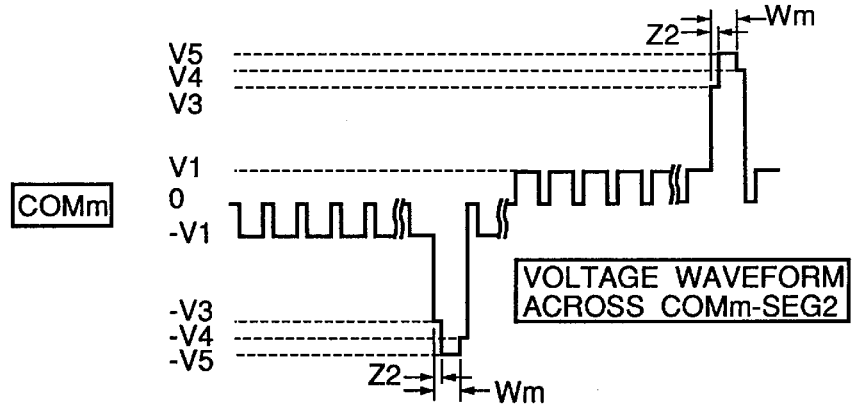
Figure 19A:
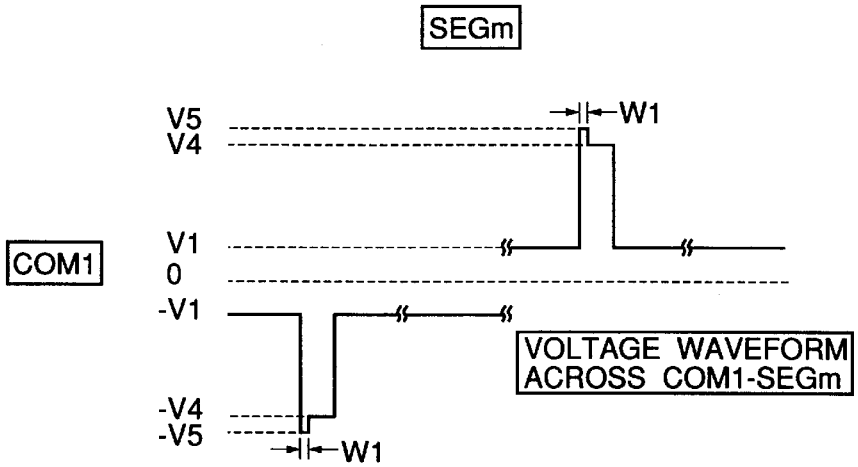
FIGS. 19A to 19C are charts showing the potential waveforms of pixels formed at the crossings of scanning electrodes COM1, COM2 and COMm and signal electrode SEGm, respectively according to the fourth embodiment of the invention.
Figure 19B:
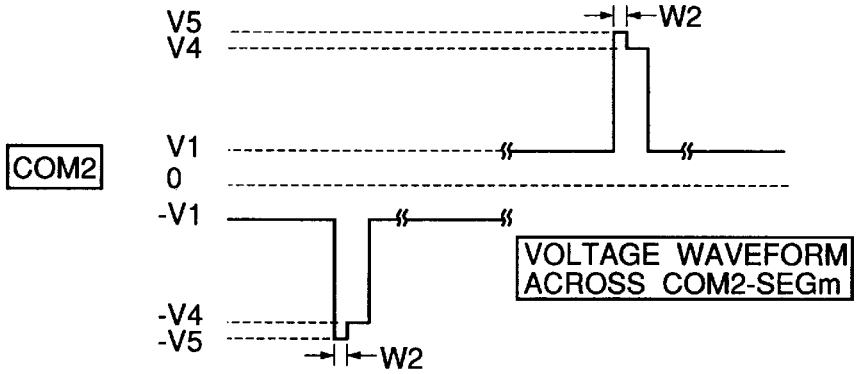
Figure 19C:
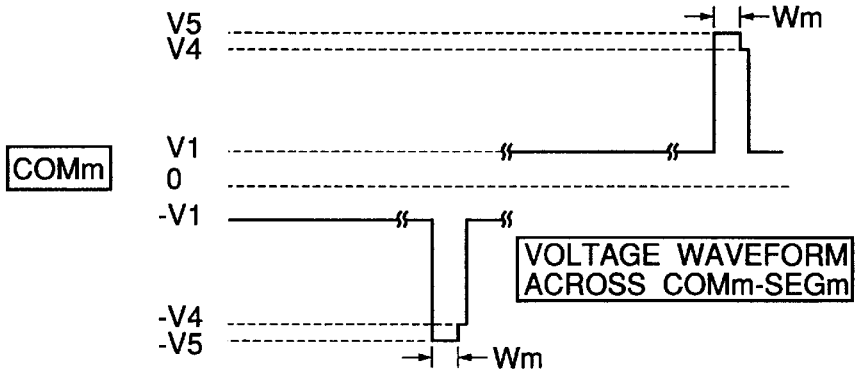

FIG. 16A to 16F are timing charts for use in illustration of the operation of scanning side driving circuit 11A and signal side driving circuit 12A. FIGS. 16A to 16F show the potential waveforms of VCOM1, VCOM2, VCOMm, VSEG1, VSEG2 and VSEGm applied to scanning electrodes COM1, COM2 and COMm and signal electrodes SEG1, SEG2, and SEGm, respectively shown in FIG. 15. Periods P1, P2 and Pm are periods for selecting scanning electrodes COM1, COM2 and COMm, respectively, and periods W1, W2 and Wm are correction periods for scanning electrodes COM1, COM2 and COMm. Periods Z1, Z2 and Zm correspond to periods for applying intermediate potentials to signal electrodes SEG1, SEG2 and SEGm. The potential applied to a pixel formed at the crossing of each scanning electrode COMi and each signal electrode SEGi corresponds to the difference between potential applied to scanning electrode COMi and potential applied to signal electrode SEGi. FIGS. 17A to 17C, 18A to 18C and 19A to 19C show the waveforms of potentials at pixels formed at the crossings of scanning electrodes COM1, COM2 and COMm and signal electrodes SEG1, SEG2 and SEGm, respectively according to the fourth embodiment of the invention. Herein, V1=VS1−VC0, V2=VC0−VC3, V3=VC0−VC4, V4=VS1−VC3 and V5=VS1−VC4. Note that FIGS. 17A to 17C show the waveforms of potentials applied to the pixels on signal electrode SEG1 with reference to scanning electrode COMi, FIGS. 18A to 18C similarly show the waveforms of potentials applied to pixels on signal electrode SEG2, and FIGS. 19A to 19C similarly show the waveforms of potentials applied to pixels on signal electrode SEGm.

Thus, correction period Wi for scanning electrode COMi is adjusted for each scanning electrode COMi, and intermediate potential application period Zi for signal electrode SEGi is adjusted for each signal electrode SEGi, so that the effective voltage value to each pixel may be adjusted on a scanning electrode COMi-basis and a signal electrode SEGi-basis, and unevenness in display quality caused by the difference between the actual effective voltage value and the optimum effective voltage value at each part of liquid crystal display panel 10 may be improved. Since the amount of correction of the effective voltage value used for the improvement is not changed analog-wise, crosstalk will not increase.

In the first to fourth embodiments, without display pattern dependence and increase in crosstalk, unevenness in display quality caused by the difference between the actual effective voltage value and optimum effective voltage value of each part in liquid crystal display panel 10 which is caused by variations in the thickness, cells irregularity of alignment and temperature variations in liquid crystal display panel 10 can be improved.

Furthermore, unevenness in display quality caused when an equal effective voltage value is not applied to the liquid crystal material of liquid crystal display panel 10 at each part such as display gradation caused by a drop in voltage by the transparent electrode resistance of liquid crystal display panel 10 may be improved by a method of adjusting effective voltage applied to each part of liquid crystal display panel 10 by applying correction voltage to the effective voltage according to the first to fourth embodiments.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display comprising a liquid crystal display panel including a signal side substrate having an arrangement of a plurality of signal electrodes, a scanning side substrate disposed opposite to said signal side substrate and having an arrangement of a plurality of scanning electrodes disposed in crossing relationship to said plurality of signal electrodes, and a liquid crystal layer positioned between said signal side substrate and said scanning side substrate so as thereby to define a matrix type array of pixels, and a signal side driving circuit and a scanning side driving circuit for applying driving pulse voltage signals to said plurality of signal electrodes and said plurality of scanning electrodes, respectively, for driving the respective electrodes, and for displaying data on the pixels of said matrix type array, wherein:

(i) at the time of displaying data, during a selecting period in which selective scanning is performed for each of said plurality of scanning electrodes, said driving pulse voltage signals applied to said plurality of signal electrodes and/or to said plurality of scanning electrodes is corrected respectively by adding thereto a correction pulse voltage signal having a pulse width subject to an appropriate adjustment for each of said plurality of scanning electrodes and/or for each of said plurality of signal electrodes so as to optimize a level of effective voltage value applied to each pixel of said liquid crystal display panel;

(ii) said driving pulse voltage signals include a data voltage signal applied to said plurality of signal electrodes for displaying data, and a selecting voltage signal applied to said plurality of scanning electrodes during said selecting periods therefor for selecting and scanning said plurality of scanning electrodes when data is displayed; and (iii) said correction pulse voltage signal includes a non-selecting voltage signal applied in non-selecting periods to said plurality of scanning electrodes and having a level different from said selecting voltage signal, and said non-selecting voltage signal is applied to said plurality of scanning electrodes for a first prescribed time period in said selecting periods for said scanning electrodes and said first prescribed time period is subjected to said adjustment for each of said plurality of said scanning electrodes.

2. A liquid crystal display comprising a liquid crystal display panel including a signal side substrate having an arrangement of a plurality of signal electrodes, a scanning side substrate disposed opposite to said signal side substrate and having an arrangement of a plurality of scanning electrodes disposed in crossing relationship to said plurality of signal electrodes, and a liquid crystal layer positioned between said signal side substrate and said scanning side substrate so as thereby to define a matrix type array of pixels, and a signal side driving circuit and a scanning side driving circuit for applying driving pulse voltage signals to said plurality of signal electrodes and said plurality of scanning electrodes, respectively, for driving the respective electrodes, and for displaying data on the pixels of said matrix type array, wherein:

(i) at the time of displaying data, during a selecting period in which selective scanning is performed for each of said plurality of scanning electrodes, said driving pulse voltage signals applied to said plurality of signal electrodes and/or to said plurality of scanning electrodes is corrected respectively by adding thereto a correction pulse voltage signal having a pulse width subject to an appropriate adjustment for each of said plurality of scanning electrodes and/or for each of said plurality of signal electrodes so as to optimize a level of effective voltage value applied to each pixel of said liquid crystal display panel;

(ii) said driving pulse voltage signals include a data voltage signal applied to said plurality of signal electrodes for displaying data, and a selecting voltage signal applied to said plurality of scanning electrodes during said selecting periods therefor for selecting and scanning said plurality of scanning electrodes when data is displayed; and (iii) said correction pulse voltage signal includes an intermediate voltage signal applied to said plurality of signal electrodes when data is not displayed, said intermediate voltage signal is applied to said plurality of signal electrodes for a second prescribed time period if said data voltage signal is applied, and said second prescribed time period is subjected to said adjustment for each of said plurality of signal electrodes.

* * * * *